US008397642B2

(12) United States Patent
Miguelez Tapia

(10) Patent No.: US 8,397,642 B2
(45) Date of Patent: Mar. 19, 2013

(54) METHOD FOR THE INSTALLATION OF RAILWAY TRACKS ON BALLAST, WITHOUT AN AUXILIARY TRACK

(75) Inventor: Francisco Javier Miguelez Tapia, Madrid (ES)

(73) Assignee: FCC Constructions, S.A., Madrid (ES)

( * ) Notice: Subject to any disclaimer, the term of this patent is extended or adjusted under 35 U.S.C. 154(b) by 0 days.

(21) Appl. No.: 12/819,682

(22) Filed: Jun. 21, 2010

(65) Prior Publication Data

US 2010/0320280 A1 Dec. 23, 2010

(30) Foreign Application Priority Data

Jun. 23, 2009 (ES) ..... 200901480

(51) Int. Cl.
*E01B 29/05* (2006.01)

(52) U.S. Cl. ..... 104/2; 104/7.1

(58) Field of Classification Search ..... 104/2, 3, 104/4, 5, 7.1, 7.2, 8, 15, 16, 6; 219/53, 54; 414/339, 373, 395, 486, 529, 800
See application file for complete search history.

(56) References Cited

U.S. PATENT DOCUMENTS 3,557,703 A * 1/1971 Moorefield et al. ..... 104/2
3,635,164 A * 1/1972 Patton ..... 104/307
3,754,505 A * 8/1973 Dyballa ..... 104/5
4,657,099 A * 4/1987 Baltensperger ..... 180/9.28
5,181,472 A * 1/1993 Scheuchzer ..... 104/2
5,271,047 A * 12/1993 Freneix ..... 376/260
5,520,497 A * 5/1996 Hertelendi et al. ..... 414/529
5,630,365 A * 5/1997 Hertelendi ..... 104/5
5,961,271 A * 10/1999 Theurer et al. ..... 414/339
6,375,402 B1 * 4/2002 Hertelendi et al. ..... 414/373
6,981,452 B2 * 1/2006 Herzog et al. ..... 104/2
7,470,871 B2 * 12/2008 Theurer et al. ..... 219/53
7,478,596 B2 * 1/2009 Theurer ..... 104/2
7,707,943 B2 * 5/2010 Herzog et al. ..... 104/2
2007/0199472 A1 * 8/2007 Theurer et al. ..... 104/7.1
2008/0072783 A1 * 3/2008 McCulloch ..... 104/2
2008/0230520 A1 * 9/2008 Lichtberger et al. ..... 219/53
2009/0095188 A1 * 4/2009 Bounds ..... 104/2
2011/0052364 A1 * 3/2011 McCulloch ..... 414/800

* cited by examiner

*Primary Examiner* — Mark Le
(74) *Attorney, Agent, or Firm* — Sturm & Fix LLP

(57) ABSTRACT

A method for installing railway tracks onto ballast beds avoiding the need for installing any type of auxiliary track. The method comprises successive stages to be carried out after having located the sleepers onto the ballast bed, consisting of fixing and laying of a pair of rails from a mini train, for the transport of the rails with the fastening and traction of same up to their complete unloading, the operation being guided by means of a discharge wagon; supporting the rails on rollers for the longitudinal movement thereof; cutting, squaring and fixing the adjacent ends to the consecutive rails; raising the rail with the help of a crane, and removing the rollers; partial fastening of the track and placement of the rollers for the next cycle, and removing the tractor from the mini train, and the final fastening of the rails.

2 Claims, 1 Drawing Sheet

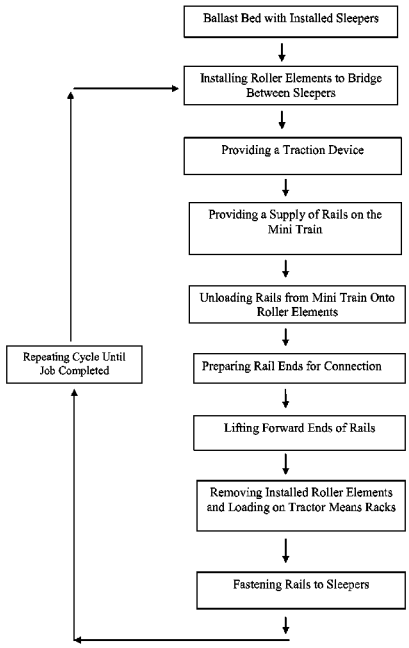

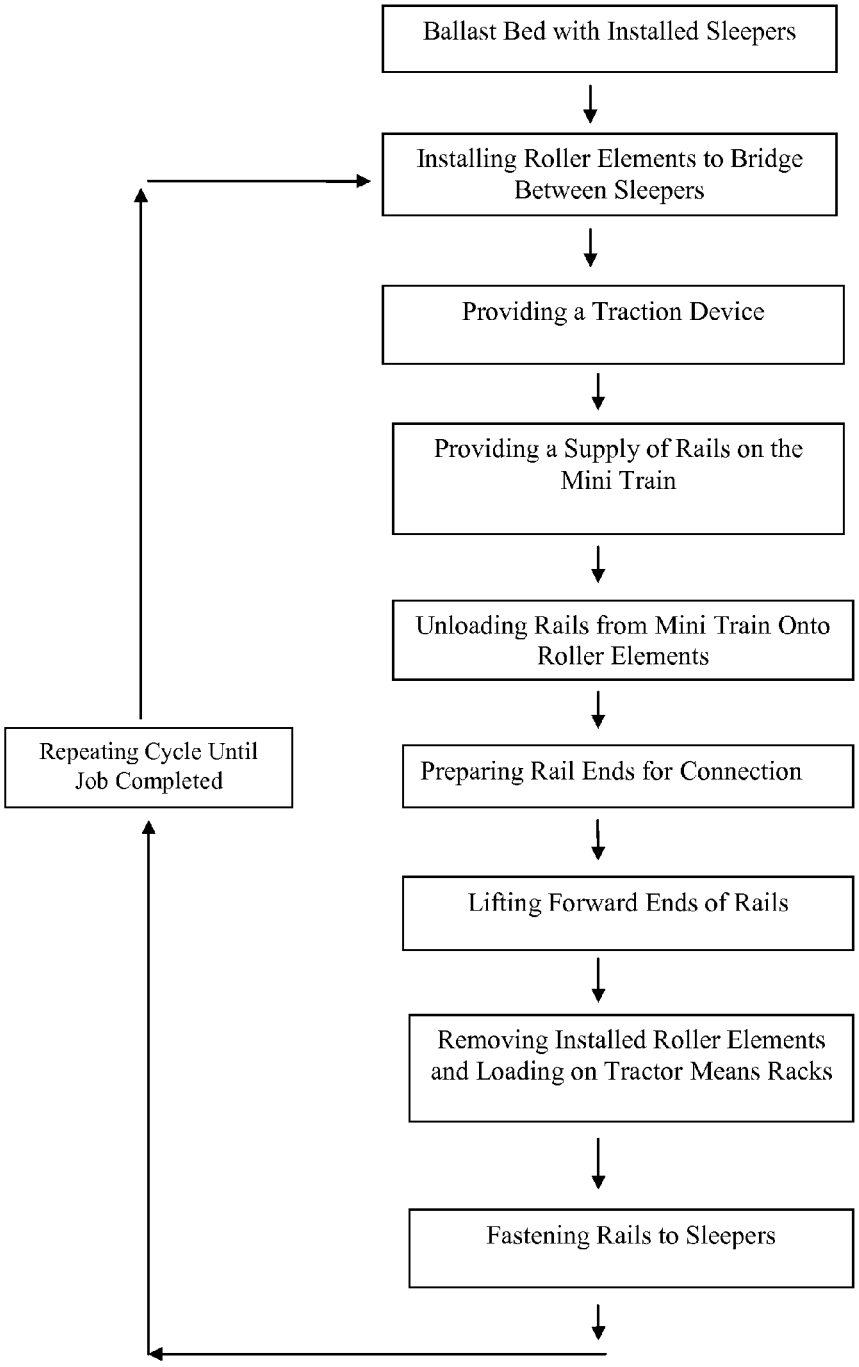
Ballast Bed with Installed Sleepers
Installing Roller Elements to Bridge Between Sleepers
Providing a Traction Device
Providing a Supply of Rails on the Mini Train
Unloading Rails from Mini Train Onto Roller Elements
Preparing Rail Ends for Connection
Lifting Forward Ends of Rails
Removing Installed Roller Elements and Loading on Tractor Means Racks
Fastening Rails to Sleepers
Repeating Cycle Until Job Completed

METHOD FOR THE INSTALLATION OF RAILWAY TRACKS ON BALLAST, WITHOUT AN AUXILIARY TRACK

CROSS REFERENCE TO RELATED APPLICATIONS

This application claims priority of ES Application No. P200901480 filed Jun. 23, 2009, which is incorporated by reference herein in its entirety.

BACKGROUND OF THE INVENTION

Field of the Invention

The present invention refers to a method for the installation of railway tracks on ballast, without an auxiliary track, that contributes essential characteristics of novelty and appreciable advantages compared to the other known and used methods used for the same purposes in the current state of the art.

More specifically, the invention allows a method to be put into practice that has been specially conceived and designed to simplify, speed up and to reduce costs in that which refers to the installation processes of railway tracks on ballast, with the use of a reduced number of external devices and elements, that have been modified and adapted for their specific application in the proposed object, with the consequent optimisation of the production processes. The installation method allows the rails of the railway to be unloaded and positioned by cycles with a predetermined length, with a net increase in performance compared to the conventional methods thanks to the substantial increase in the number of cycles per production day.

The field of application of the invention is clearly to be found within the industrial sector involved in the installation and laying of railway tracks on ballast.

BRIEF SUMMARY OF THE INVENTION

Over time ballast has formed a particularly suitable base for the laying of railway tracks across the designed and previously established distances. The ballast consists of broken stones that, appropriately laid, provides a suitable bed for the support of the sleepers onto which the rails making up the railway line can rest, providing stability to the railway track, and managing to ensure that it keeps the original geometry that was conceived during the construction. In addition, it fulfils other important functions, such as the appropriate distribution and dispersal of the loads that the track transmits to the land, in such a way that the resulting values are admissible for it, and also allows appropriate drainage of the rainwater, thus preventing the deterioration of the assembly.

Hence, the ballast makes up a basic element on which the installation of the railway tracks has been based over time, and continues to be a main element in these types of applications in spite of the fact that other support beds are known in these times that can be particularly suitable under certain circumstances, but under no circumstances can the total replacement of ballast be envisaged, at least for the short term.

Given the favourable characteristics inherent in the ballast beds, there continues to be research in respect of methods that allow for improvements in the installation and assembly processes of the tracks onto these beds, as occurs in the case of the present invention, by means of which an optimised method has been developed for the installation of railway tracks, substantially simpler, quicker and cheaper than the conventional methods, given that the new method does not need to resort to the use of any type of auxiliary track.

In effect, in many conventional railway track installation methods it is normal that together with the main track a temporary auxiliary track is built that is normally used for the purposes of supply. This auxiliary track is made up of wooden sleepers and secondary use lines, laid along a predetermined length and built on the basis of stretches of line having a reduced length so as to optimise the transport.

This present invention provides an optimised method for the installation of railway tracks on ballast, by means of which the need for the installation, assembly or use of any auxiliary track is eliminated, and in addition is built on the basis of a reduced number of external devices, namely: A discharge (unloading) wagon, a tractor device, and a predetermined number of slide elements for the rails (also called 'rollers', whose main characteristics are stated below.

Discharge Wagon:

It consists of a wagon that is coupled to the mini train for the transport of rails, at the unloading end of the rails. The purpose of this discharge wagon is to prevent deflections of the rail during the unloading, which can bring about permanent deformities to same. The wagon makes it easier to unload the rails in pairs with predetermined lengths (for example, 270 meters in length), for which purpose it has some devices to drive the bars in a parallel manner on supports that take them and steer them. In the same way, the discharge wagon can also be used for the transporting of small sized materials and other consumables.

Tractor Device

This device is applicable during the installation of the track, for the carrying out of specific functions such as the pulling of the rail during the unloading operation of same, the lifting of the rail for the extraction of the rail slide elements onto which it will be moved during the unloading, and the transporting of the slide elements for the rail, once recovered.

In general, the tractor device can be any conventional device, adapted and fitted for the carrying out of the previously stated tasks. On one preferred, simplified embodiment of the tractor device, this was obtained from a mini back shoe excavator, suitably modified to increase the width of same in such a way that the side tracks are separated from each other with enough space between them to allow the laying of the track with the sleepers duly located in their respective positions. The tracks allow the tractor device to be able to move and to go along the sides of the ballast bed, or even on the stones of the residual side parts of same. The tractor device is also fitted with side trays which, in a manner like panniers arranged on the chassis of the original engine, allow the storage and transporting of other components such as, for example, the slide elements for the rails.

The tractor is also fitted with some crane device, by means of which it carries out the rail lifting operation as was alluded to in the above.

Rail Slide Elements

Also known as 'rollers', each one of these elements consists of a metallic sheet or profile, made of steel, with a length such that it can be extended between, and fixed to, two consecutive sleepers like a bridge, for example with a length of 90 cm. Said profile carries a welded roller which is used to make the movement easier of the rail that is supported on it during the longitudinal movement in the direction of the installation. The elements or rollers are arranged on both sides, for each rail, successively keeping a certain equidistance, for example every 18 sleepers, which is a separation of approximately 10.8 meters between each two consecutive rollers.

With only the aid of the devices and means that have just been described, it is possible to carry out the procedure of the invention, with construction process performance that is much greater than other conventional methods where the help of a greater number of devices is needed.

BRIEF DESCRIPTION OF THE DRAWINGS

These and other attributes of the invention will become more clear upon a thorough study of the following description of the best mode for carrying out the invention, particularly when reviewed in conjunction with the drawing, wherein:

The single drawing is a flow diagram showing the steps of the method of the present invention.

DETAILED DESCRIPTION OF THE INVENTION

In accordance with the above, the detailed description of the method proposed by the invention is going to be carried out in the following with express definition of the details that characterise each one of the construction phases included in the process. Hence, in the first place the construction of the ballast bed and the positioning on the same of the plurality of sleepers to help and support the rails is proceeded with, following the layout planned for the railway track.

With the sleepers in place, the rail slide elements (rollers) are placed on said sleepers, each one of said rollers extended forming a bridge between two consecutive sleepers as has been said, and with a separation at a previously determined distance.

Next, by bringing said mini train nearer towards the construction stretch, to make available the sections of rail with a predetermined length (in the example about 270 meters) the coupling is carried out of the unloading wagon to be used during the supported and guided unloading of said rail sections, with said mini train for the transportation of the rails.

After this, in the following phase the operation for the fixing of a pair of rails is carried out on the last wagon of the mini train with the devices used to drive and move the rails in the discharge direction with the aid of the tractor device. After this, a fastening operation is carried out on the pair of rails and traction is exercised on same by the tractor device until the complete discharge of the rails from the mini train wagon is achieved, as has been said this operation is made easier by the guidance mechanisms fitted to the discharge wagon, and with the rails being driven and guided they are supported on the rollers of movement elements that were previously placed on the track sleepers.

With the rails in those conditions an operation for cutting, squaring and fixing of same is carried, this is, an operation to join the ends of the consecutively adjacent rails.

Once having finished the previous operation the lifting of the rails on each side is proceeded with so as to recover the rollers (or movement elements) that enabled the longitudinal movement of each rail. This operation is carried out with the lifting devices or crane incorporated into the tractor device, and consists of raising each rail, holding it by one end (the free end), so as to allow the stated slider elements to be removed, which are in turn loaded onto the tractor device itself, in accordance with that said, for its transport to the next working position.

Once having completed the previous stage the partial fastening of the track is proceeded with (one sleeper for every so many units, for example one sleeper for each 7 units), and for the placement of the rollers for the next cycle.

Finally, the mini train is withdrawn back from the tractor device, and the fastening of the track is finished, all of the components and devices being ready for the commencement of a new cycle.

As can be appreciated, the method of the invention in the above description, considerably simplifies the operating practices of the current methods, with the use of a reduced number of resources or equipment, with a highly increased performance as to operativity and costs compared to the methods used in the current state of the art.

It is not considered as being necessary to make the contents of this present description more extensive as a skilled person in this field can understand its scope and the advantages that arise from same, likewise how to carry out the practical embodiment of its object. In spite of the above, it must be understood that the description given only corresponds to an example of a preferred embodiment, and therefore it is capable of having changes, modifications or alterations made both in regard to the construction phases and equally the methods used, without this meaning any alteration to the scope of the protection provided by the method of the invention.

The invention claimed is:

1. Installation method for railway tracks on ballast, without auxiliary track, comprising the steps of:

(a) making of a ballast bed and installing a plurality of sleepers on the ballast bed;

(b) installing a plurality of roller elements on the already installed sleepers, each roller element being supported on two successive sleepers forming a bridge between the two successive sleepers, consecutively separated from each other at a predetermined distance;

(c) providing a tractor device having ground engaging elements that span the installed sleepers and move longitudinally with respect to the ballast bed;

(d) providing a supply of rails on a mini train;

(e) unloading a pair of rails from the mini train onto the roller elements, and longitudinally moving the pair of rails on the roller elements up to their placement on the sleepers;

(f) cutting, squaring and fixing of the rails for connecting adjacent ends of adjacent rails;

(g) lifting a forward end of each rail;

(h) removing the roller elements;

(i) fastening the rails to the sleeper; and (j) repeating steps (b) through (i) until installation of the railway tracks is completed.

2. Installation method for railway tracks on ballast, without auxiliary track, comprising the steps of:

(a) making of a ballast bed and installing a plurality of sleepers on the ballast bed;

(b) installing a plurality of roller elements on the already installed sleepers, each roller element being supported on two successive sleepers forming a bridge between the two successive sleepers, consecutively separated from each other at a predetermined distance, each one of these roller elements being fitted with a support and guidance roller for longitudinal movement of a rail up to its corresponding placement;

(c) providing a mini train for transport of rails, and coupling the mini train to a discharge wagon fitted with a guidance mechanism for guided unloading and lifting of rails by pairs;

(d) fixing of the pair of rails at an unloading end, and fastening them with a traction device for unloading said pair of rails;

(e) unloading the pair of rails through the discharge wagon onto said rollers of the roller elements using a tractor device, which spans the entire width of the track;

(f) cutting, squaring and fixing of the rails for connection of adjacent ends of adjacent rails;

(g) lifting a forward end of each rail with a lifting device fitted to the tractor device;

(h) removal of the roller elements and the loading the roller elements onto racks disposed on both sides of the tractor device;

(i) partial fastening of every rail to each sleeper; and (j) repeating steps (b) through (i) until installation of the railway tracks is completed.

* * * * *